US006309265B1

(12) United States Patent
Oguma

(10) Patent No.: US 6,309,265 B1
(45) Date of Patent: Oct. 30, 2001

(54) POWER TILT AND TRIM SYSTEM FOR OUTBOARD DRIVE

(75) Inventor: Takahiro Oguma, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/546,217

(22) Filed: Apr. 10, 2000

(30) Foreign Application Priority Data

Apr. 9, 1999 (JP) ..... 11-103367

(51) Int. Cl.[7] ..... B63H 5/125
(52) U.S. Cl. ..... 440/61; 440/53
(58) Field of Search ..... 440/53, 61, 88

(56) References Cited

U.S. PATENT DOCUMENTS

| | | | | |
|---|---|---|---|---|
| 3,240,452 | * | 3/1966 | Cheeseboro | 248/562 |
| 3,473,325 | * | 10/1969 | Vargo | 60/468 |
| 3,839,986 | * | 10/1974 | Meyer et al. | 440/53 |
| 4,687,448 | * | 8/1987 | Peirce | 440/53 |
| 5,032,094 | | 7/1991 | Katogi . | |
| 5,049,098 | * | 9/1991 | Binversie et al. | 440/61 |
| 5,049,099 | | 9/1991 | Ito et al. . | |
| 5,149,285 | | 9/1992 | Kinoshita . | |
| 5,358,436 | | 10/1994 | Soda et al. . | |
| 5,746,055 | * | 5/1998 | Nakamura et al. | 60/454 |
| 6,139,380 | * | 10/2000 | Uematsu | 440/61 |

FOREIGN PATENT DOCUMENTS

| | | | | |
|---|---|---|---|---|
| 62-251295 | * | 1/1987 | (JP) | 440/61 |
| 4-5190 | * | 1/1992 | (JP) | 440/61 |
| 4-5194 | * | 1/1992 | (JP) | 440/61 |
| 4-163292 | * | 6/1992 | (JP) | 440/61 |
| 4-232193 | * | 8/1992 | (JP) | 440/61 |

* cited by examiner

*Primary Examiner*—S. Joseph Morano
*Assistant Examiner*—Ajay Vasudeva
(74) *Attorney, Agent, or Firm*—Knobbe, Martens, Olson & Bear, LLP

(57) ABSTRACT

A power tilt and trim system for an outboard drive includes an improved construction that can be formed in compact nature without significantly reducing its strength. The system includes a support member that couples to the outboard motor. The support member has a pair of bracket arms spaced apart from each other and one of the bracket arms has an opening. An actuator is nested between the bracket arms to tilt the outboard drive. A powering assembly is disposed next to the actuator and arranged to power the actuator. At least a portion of the powering assembly lies within the opening.

23 Claims, 12 Drawing Sheets

POWER TILT AND TRIM SYSTEM FOR OUTBOARD DRIVE

PRIORITY INFORMATION

This application is based on and claims priority to Japanese Patent Application No. 11-103367, filed Apr. 9, 1999, the entire contents of which is hereby expressly incorporated by reference.

BACKGROUND OF THE INVENTION

1. Field of the Invention

This invention relates to an outboard drive unit for a watercraft, and more particularly to a power tilt and trim system for an outboard drive unit.

2. Description of Related Art

Outboard motors with four stroke engines have grown in popularity in recent years, due in part to environmental concerns associated with two stroke outboard motors. The application of four-cycle engines in outboard motors, however, has raised some challenges, especially with large horsepower engines. A four-stroke engine will weigh significantly more than a two-stroke engine that produces a comparable horsepower to that of the four-stroke engine. The additional weight requires a hydraulic power tilt and trim system even for an outboard motor that employs a small horsepower engine.

The hydraulic power tilt and trim system supports an outboard motor on a watercraft and adjusts the trim and tilt position of a drive unit of the outboard motor. A tilt and trim adjustment mechanism of the system commonly includes at least one hydraulic actuator which operates between a clamping bracket and a swivel bracket. The clamping bracket is attached to the watercraft and the swivel bracket supports the drive unit. A pivot pin connects together the swivel and clamping brackets. The actuator causes the swivel bracket to pivot about the axis of the pivot pin, relative to the stationary clamping bracket, to raise or lower the drive unit. The actuator usually includes a closed cylinder and a piston slidably supported within the cylinder.

The actuator has two particular roles. One role is to adjust trim angles of the drive unit so as to adjust further positions of an associated watercraft. This trim adjustment can be done within a trim range in which the drive unit moves from a fully lowered down position to a certain raised up position, i.e., a fully trimmed up position. Another role of the actuator is to bring the drive unit out of the surrounding water halfway or completely and vice versa. This movement is done within a tilt range in which the drive unit moves to a fully trimmed up position, i.e., fully tilted down position to a fully tilted up position.

Tilt and trim adjustment mechanisms also usually employ a powering assembly that affects the trim and tilt operations of the drive unit. For this purpose, powering assemblies have included a reversible electric motor that selectively drives a reversible fluid pump. The pump pressurizes or depressurizes the actuator for raising or lowering the drive unit.

In particular, the fluid pump supplies pressurized fluid to various ports of the actuator's closed cylinder, on either side of a piston that slides within the cylinder. The piston forms separate chambers within the cylinder. A conventional seal, such as one or more O-rings, operates between the piston and cylinder bore to prevent flow between the chambers. The piston moves within the cylinder by pressurizing the chamber on one side of the piston and depressurizing the other chamber on the opposite side.

An actuator arm is attached to the piston and to the swivel bracket. The other end of the cylinder is attached to the clamping bracket. Alternatively, the actuator arm can be attached to the clamping bracket and the other end of the cylinder can be attached to the swivel bracket. By pressurizing and depressurizing the chambers within the actuator, the piston and thus the drive unit can be moved.

U.S. Pat. No. 5,049,099 illustrates a typical arrangement of the actuator and powering assembly. In this arrangement, a single actuator and a powering assembly are located adjacent to each other in a side-by-side relationship. The powering assembly formed by the pump, reservoir and motor extends along side the actuator for most of the actuator's length. Both the actuator and the powering unit lie between bracket arms of the clamping and swivel brackets. While these components are shielded in this position, the resulting assembly off sets the actuator from the center of gravity of the drive unit. That is, the stroke axis of the actuator and the center of gravity of the drive unit which it moves, are not within the same plane. Consequently more force is required to raise the drive unit, which increases the size of the actuator.

With large size outboard motors, this result was relatively acceptable. However, small size motors were forced to have other structures to accommodate the resulting larger sizes of the actuator, motor and pump. One approach for resolving the problem involves providing a completely separate power tilt and trim device and instructing a user of the motor to attach it to the outboard motor in his or her option. This approach requires too much work for the user. Thus, another solution is still sought.

In addition, preferably, the swivel and clamping brackets are reinforced to handle the increased weight. Even though additional reinforcing is difficult, the brackets should not lose their conventional sizes so as to preserve necessary strength. In particular, the bracket arms should keep sufficient lengths for securely supporting the drive unit on the associated watercraft.

Although the problems are notable with a small size outboard motor that employs a four-stroke engine, a large size motor that employs a four-stroke or two-stroke engine may have the same problems.

A need therefore exists for an improved construction of a power tilt and trim system that can support a drive unit in compact nature without significantly reducing construction strength.

SUMMARY OF THE INVENTION

In accordance with one aspect of the present invention, a hydraulic tilt and trim system for an outboard drive comprises a support member that couples to the outboard a drive. The support member includes a pair of bracket arms spaced apart from each other. One of the bracket arms has an opening. An actuator is nested between the bracket arms and is arranged to tilt the outboard drive. A powering assembly is disposed next to the actuator and arranged to power the actuator. At least a portion of the powering assembly lies within the opening. In a preferred form, at least a portion the powering assembly extends through the opening.

In accordance with another aspect of the present invention, a hydraulic tilt and trim system for an outboard drive comprises a clamping bracket the includes a pair of arm members spaced apart from each other. One of the arm members has a through-hole. A swivel bracket supports the outboard drive. An actuator is arranged to operate generally between the clamping bracket and the swivel bracket. The actuator includes a variable volume fluid chamber and an extendable rod. A pump selectively supplies a working fluid to the fluid chamber so as to move the rod. A motor selectively drives the pump. At least a portion of the motor extends through the hole.

In accordance with a further aspect of the present invention, a hydraulic tilt and trim system for an outboard drive that has a propulsion unit comprises a clamping bracket adapted to be affixed to an associated watercraft. A swivel bracket is held by the clamping bracket for pivotal movement about a generally horizontally extending pivot axis and supports the propulsion unit for pivotal movement about a generally vertically extending steering axis. The clamping bracket includes a pair of arm members spaced apart from each other. One of the arm members has a through-hole. A cylinder is provided. A piston is slidably supported within the cylinder and defines a variable volume fluid chamber. An actuator rod extends from the piston beyond the cylinder. One of the cylinder and the actuator rod is affixed to a shaft that connects the respective arm members for pivotal movement. The other one of the actuator rod and the cylinder is affixed to the swivel bracket for pivotal movement. A powering assembly is disposed near to the cylinder so as to selectively supply working fluid to the fluid chamber. A portion of the powering assembly extends through the hole of the arm member.

In accordance with another aspect of the present invention, a hydraulic tilt and trim system for an outboard drive comprises a support member that couples to the outboard drive. The support member includes a pair of bracket arms spaced apart from each other. One of the bracket arms has a hollow. An actuator is nested between the bracket arms and arranged to tilt the outboard drive. A powering assembly is disposed next to the actuator and arranged to power the actuator. At least a portion of the powering assembly lies within the hollow.

In accordance with an yet further aspect of the present invention, an outboard motor comprises an internal combustion engine for powering a marine propulsion device. The engine has a cylinder body that defines at least one cylinder bore in which a piston reciprocates. A cylinder head closes an end of the cylinder body and defines a combustion chamber with the piston and the cylinder head. An air induction device is arranged to supply an air charge to the combustion chamber. The cylinder body has a pair of sides that extend generally along a reciprocation axis of the piston. The air induction device lies on only one of the sides. A drive unit carries the marine propulsion device. A hydraulic tilt and trim system supports the drive unit. The hydraulic tilt and trim system includes a support member that couples to the drive unit and has a pair of bracket arms spaced apart from each other. One of the bracket arms is provided with an opening. An actuator is nested between the bracket arms and arranged to tilt the drive unit. A powering assembly is disposed next to the actuator and arranged to power the actuator. At least a portion of the powering assembly extends through the opening. The bracket arm that has the opening is positioned closer to the side on which the air induction device extends than the other side of the engine.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

FIG. 6(*b*) is a schematic view showing a movement of a tilt pin when the drive is going to be held at a fully tilted up position.

DETAILED DESCRIPTION OF THE PREFERRED EMBODIMENTS OF THE INVENTION

Figure 1:
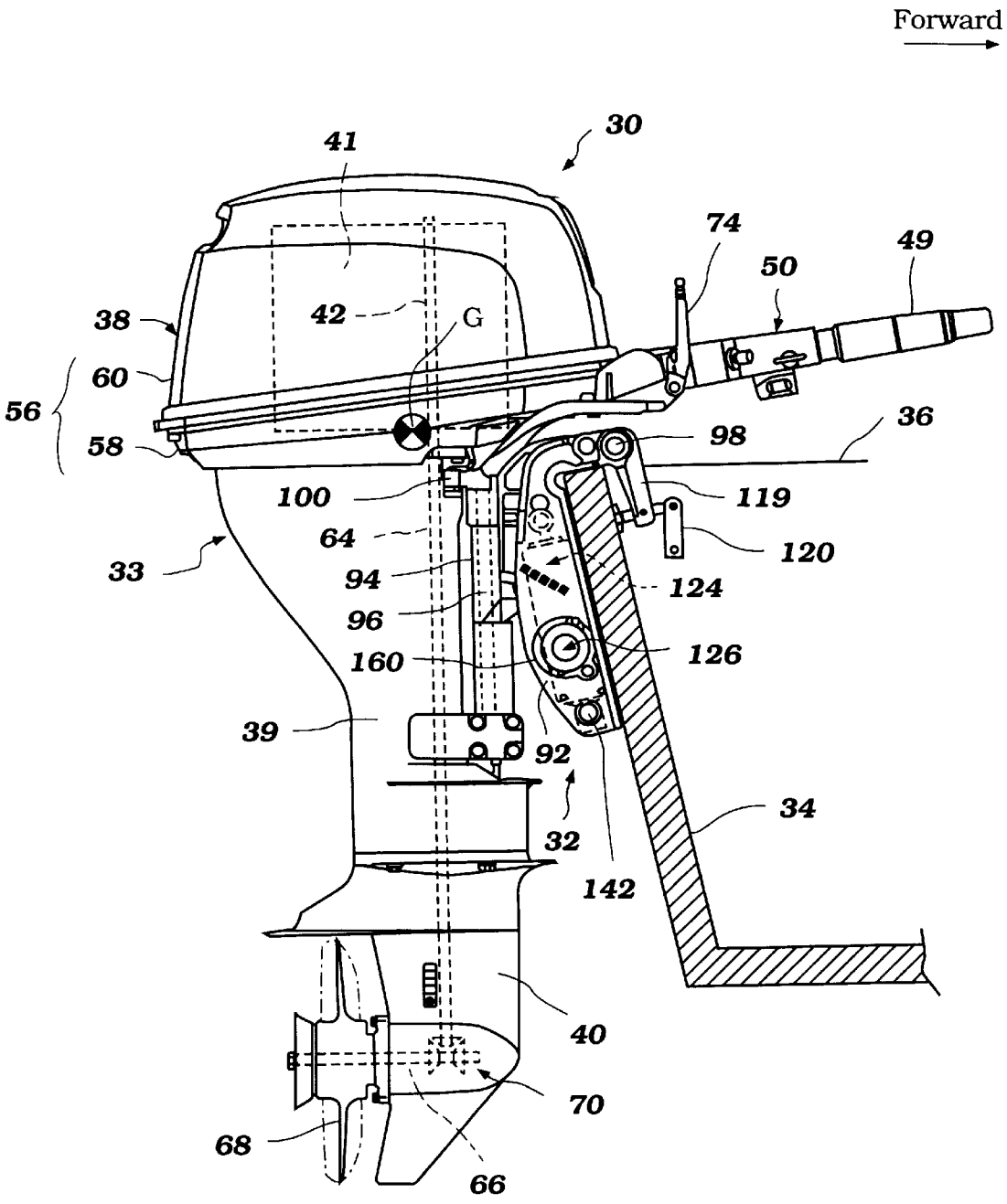
FIG. 1 is a side elevational view of an outboard motor, which includes a hydraulic tilt and trim adjustment system configured in accordance with a preferred embodiment of the present invention. The outboard motor is illustrated as attached to the transom of an associated watercraft in a fully trimmed down position. The associated watercraft is shown partially and section.
Figure 2:
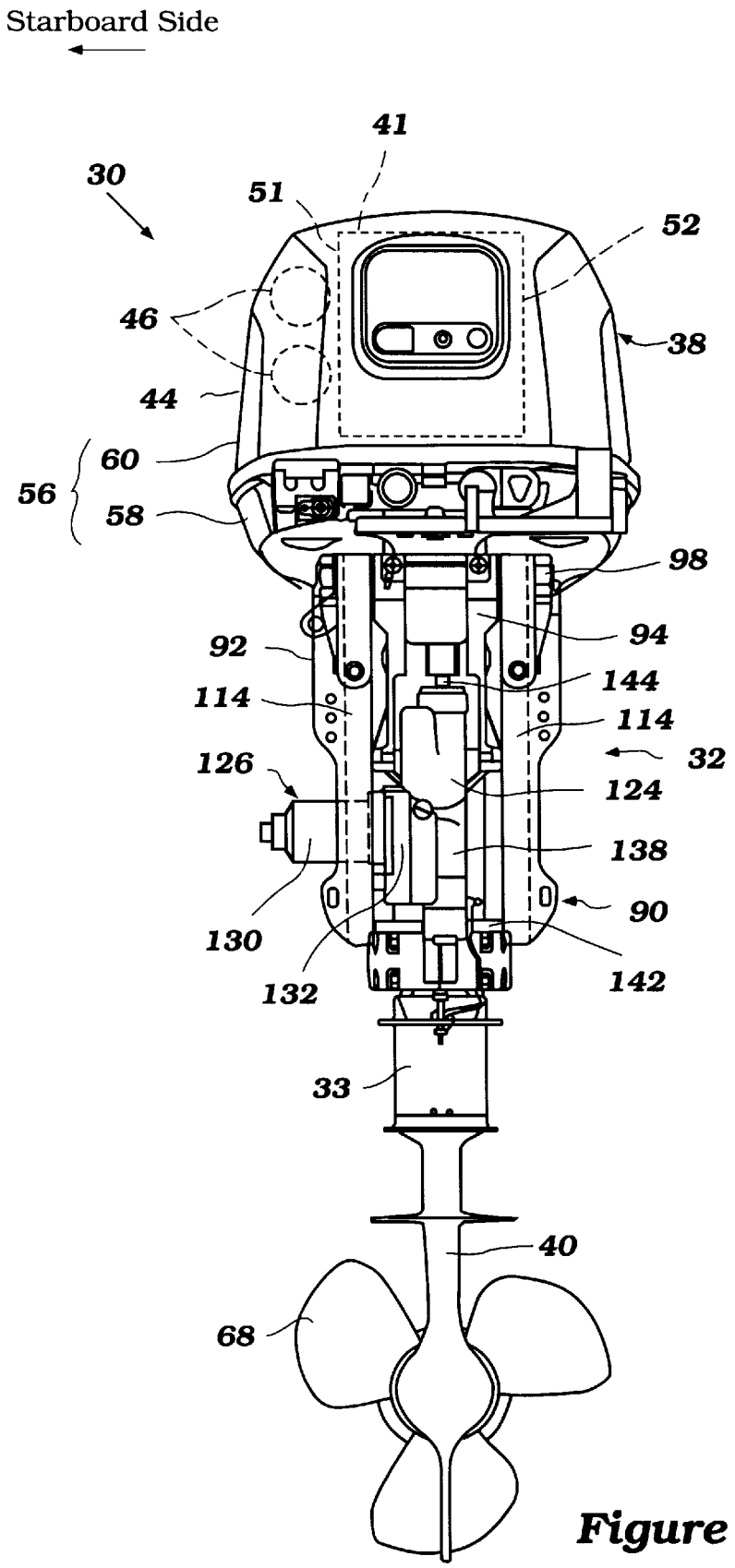
FIG. 2 is a front elevational view of the outboard motor.
Figure 3:
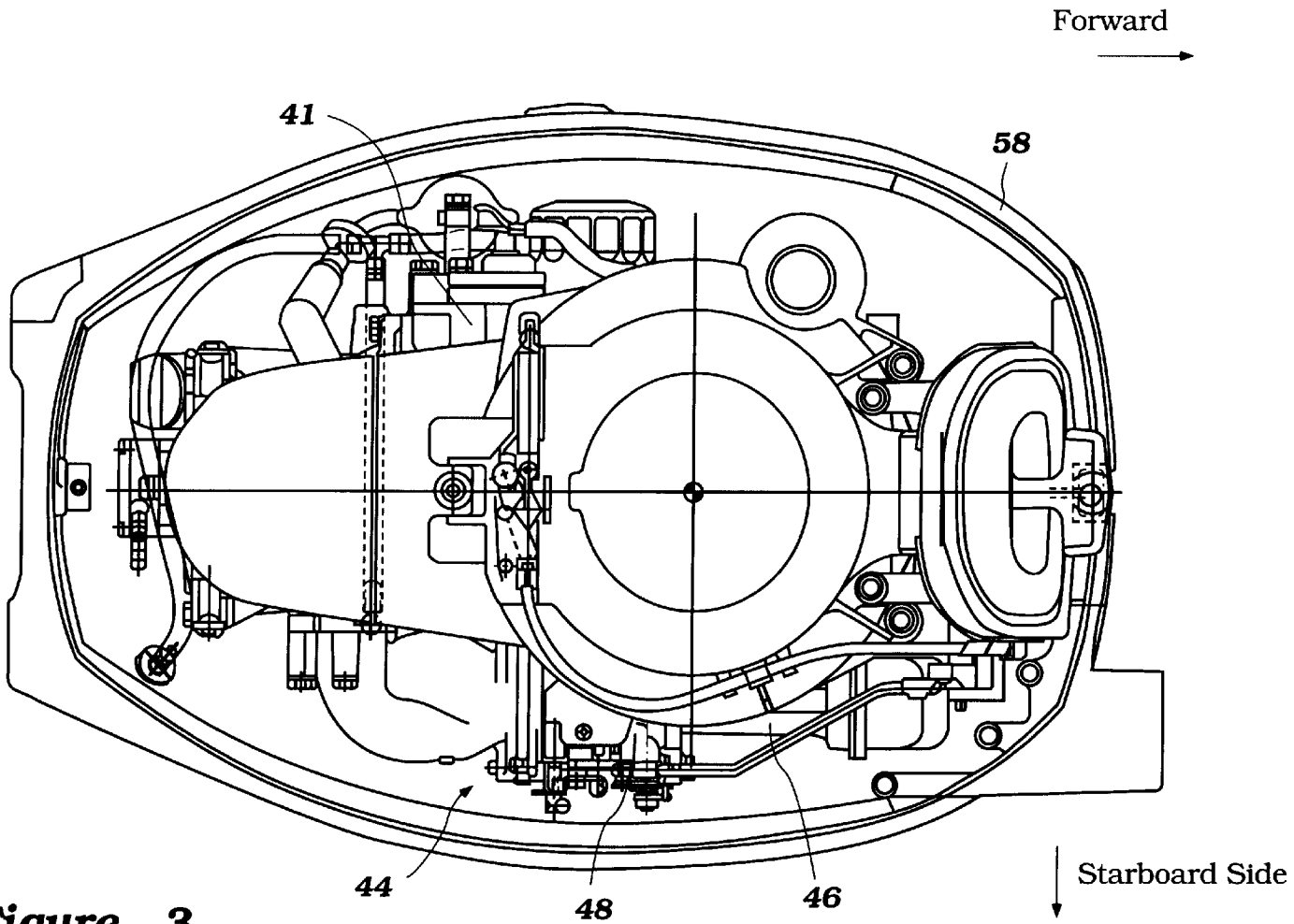
FIG. 3 is a top plan view of the outboard motor. A top protective cowling is detached to show an arrangement of an engine of the outboard motor.

With reference to FIGS. 1 to 3, an exemplary outboard motor 30, which incorporates a hydraulic tilt and trim adjustment system 32 configured in accordance with a preferred embodiment of the present invention, will be described. Because the present tilt and trim adjustment system has particular utility with an outboard motor, the following describes the tilt and trim unit in connection with such an outboard motor; however, the depiction of the invention in conjunction with an outboard motor is merely exemplary. Those skilled in the art will readily appreciate that the present tilt and trim adjustment system can be readily adapted for use with other types and sizes of outboard or marine drives (e.g., a stern drive unit).

In the illustrated embodiment, the outboard motor 30 comprises a drive unit 33 and the tilt and trim adjustment system 32 that supports the drive unit 33 on a transom 34 of an associated watercraft 36. An exemplary outboard motor is illustrated in FIG. 1, and the following will initially describe the outboard motor to provide an understanding of the illustrated environment of use.

As used through this description and claims, the terms "forward," "front," "forth" or "forwardly" mean at or to the side where the tilt and trim system 32 is located in regard to the drive unit 33 and the terms "reverse," "rearwardly" or "back" mean at or to the opposite side of the front side, unless indicated otherwise.

The drive unit 33 comprises a power head 38, a driveshaft housing 39 and a lower unit 40. The power head 38 includes an internal combustion engine 41. In the illustrated embodiment, the engine 41 is a L2 (in-line four cylinder) type and operates on a four-stroke combustion principle. The engine 41 has a cylinder body that defines two cylinder bores generally horizontally extending and spaced generally vertically with each other. A piston can reciprocate in each cylinder bore. A cylinder head is affixed to one end of the cylinder body and defines two combustion chambers with the piston and the cylinder bores. The other end of the cylinder body is closed by a crankcase member that defines a crankcase chamber with the cylinder bores. A crankshaft or output shaft 42 extends generally vertically through the crankcase chamber. The crankshaft is pivotally connected to the pistons by connecting rods and rotates with the reciprocal movement of the pistons.

As seen in FIGS. 2 and 3, the engine 41 includes an air induction device 44 that supplies an air charge to the combustion chambers. The air induction device 44 comprises a pair of air intake ducts 46 and throttle bodies 48 both corresponding to the respective combustion chambers. The air intake ducts 46 are vertically spaced apart from each other and involve the throttle bodies 48 midway thereof. The throttle bodies 48 include throttle valves that measure an amount of an air charge delivered to the combustion chambers in response to various engine-running conditions. The throttle valves are operable by a throttle controller 49 that rotates about an axis of a steering handle 50. The throttle valves have valve shafts that are coupled with the throttle controller 49 in a manner that is well known, for example, by a throttle cable or linkage. The cylinder body has a pair of sides, specifically, a starboard side 51 and a port side 52, that extend generally along reciprocation axes of the pistons. In the illustrated embodiment, the air intake ducts 46 exist only on a starboard side 51.

Although not shown, the engine 41 further includes a fuel supply system that supplies a fuel charge to the combustion chambers for combustion with the air charge, a firing system that fires the air fuel charge in the combustion chambers and an exhaust system that discharges a burnt charge or exhaust gasses out of the combustion chambers. A lubrication system, an engine cooling system and an engine control system are also employed for optimization of the engine operations.

The engine 41 can have any number of cylinders and cylinder arrangements, and can operate on a variety of known combustion principles (e.g., on a two-stroke principle). Since an engine construction and its operations are well known in the art, any further descriptions on them are believed to be unnecessary to permit those skilled in the art to practice the invention.

A protective cowling assembly 56 that completes the power head 38 surrounds the engine 41. The cowling assembly 56 includes a lower tray 58 and a top protective cowling 60. The tray 58 and the cowling 60 together define a compartment which houses the engine 41 with the lower tray 58 encircling a lower portion of the engine 41.

The driveshaft housing 39 depends from the power head 38 and supports a driveshaft 64 which is coupled with the crankshaft 42 and driven thereby. The driveshaft 64 extends generally vertically through the driveshaft housing 39 and is suitably journaled therein for rotation about the vertical axis. The driveshaft housing 39 also defines internal passages which form portions of the exhaust system.

The lower unit 40 depends from the driveshaft housing 39 and supports a propeller shaft 66 which is driven by the driveshaft 64. The propeller shaft 66 extends generally horizontally through the lower unit 40. In the illustrated embodiment, the propulsion device includes a propeller 68 that is affixed to an outer end of the propeller shaft 66 and is driven thereby. The propulsion device, however, can take the form of a dual, counter-rotating propeller system, a hydrodynamic jet, or like propulsion device. A transmission 70 is provided between the driveshaft 64 and the propeller shaft 66. The transmission 70 couples together the two shafts 64, 66 which lie generally normal to each other (i.e., at a 90° shaft angle) with a bevel gear combination.

The transmission 70 has a switchover mechanism to shift rotational directions of the propeller 68 to forward, neutral or reverse. The switchover mechanism is operable by a shift lever 74 that pivots on the steering handle 50. The switchover mechanism is coupled with the shift lever 74 in a manner that is well known, for example, by a shift cable or linkage.

The lower unit 40 also defines an internal passage that forms a discharge section of the exhaust system. At engine speed above idle, the majority of the exhaust gasses are discharged to the body of water surrounding the outboard motor 30 through the internal passage and finally through a hub of the propeller 68, as well known in the art.

Still with reference to FIGS. 1 to 3 and additionally with reference to FIGS. 4 and 5, the hydraulic tilt and trim adjustment system 32 will be described.

The tilt and trim adjustment system 32 includes a coupling assembly 90. The coupling assembly 32 supports the drive unit 33 on the watercraft transom 34 so as to place the propeller 68 in a submerged position with the watercraft 36 resting on the surface of a body of water. The coupling assembly 90 comprises a clamping bracket 92, a swivel bracket 94, a steering shaft 96 and a pivot pin 98.

The steering shaft 96 is affixed to the drive shaft housing 39 through an upper mount assembly 100 and a lower mount assembly 102. An elastic isolator connects each mount assembly 100, 102 to the drive shaft housing 39 (or to a section of the drive unit 33 connected to the drive shaft housing 39, e.g., an exhaust guide member located beneath the engine 41). The elastic isolators permit some relative movement between the drive shaft housing 39 and the steering shaft 96 and contain damping mechanisms for damping engine vibrations transmitted from the drive shaft housing 39 to the steering shaft 96.

The steering shaft 96 is rotatably journaled for steering movement about a steering axis within the swivel bracket 94. The aforenoted steering handle 50 is attached to an upper end of the steering shaft 96 to steer the drive unit 33, in a known manner. Movement of the steering handle 50 rotates the steering shaft 96, as well as the drive shaft housing 39 which is connected through the upper and lower mount assemblies 100, 102 about the steering axis.

The swivel bracket 94 includes a cylindrical housing 106 through which the steering shaft 96 extends. A plurality of bearing assemblies journal the steering shaft 96 within the cylindrical housing 106. The swivel bracket 94 includes a pair of side arms 108 (see FIG. 5) that are positioned in front of the cylindrical housing 106 and project toward the clamping bracket 92.

The swivel bracket 94 also includes a pair of lugs 110 which project forward toward the watercraft transom 34.

Each lug 110 includes a coupling hole at its front end. The coupling holes are aligned with each other along a common pivot axis.

As seen in FIG. 1, the clamping bracket 92 is affixed to the transom 34. The clamping bracket 92 includes a pair of bracket arms 114. Each bracket arm 114 has a support plate section 116 and a flange section 118. The plate sections 116 abut the outer surface of the transom 34 when the clamping bracket 92 is attached to the watercraft 36. The flange sections 118 project toward the drive unit 33 from the sides of the plate sections 116. The flange sections 118 are spaced apart from each other by a sufficient distance to receive the swivel bracket 94 therebetween. The flange sections 118 shield the space between the plate sections 116 and the cylindrical housing 106 of the swivel bracket 94 to protect the inner components of the tilt and trim adjustment system 32 that will be described shortly.

The clamping bracket 92 further includes a pair of overhang sections 119 extending from the respective flange sections 118. The overhang sections 119 are hanged over a top surface of the transom 34 to stay on the inner wall of the transom 34. Securing members 120 having screwed type fasteners are provided to fix the overhang sections 119 to the inner wall of the transom 34.

The clamping bracket 92 further has a plurality of holes 121 on both of the flange sections 118. A trim pin that determines the most lowered position of the swivel bracket 94 can be selectively positioned at one of the holes 121 if necessary.

The pivot pin 98 completes the hinge coupling between the clamping bracket 92 and the swivel bracket 94. The pivot pin 98 extends through the aligned coupling holes of the clamping bracket 92 and the lugs 110 of the swivel bracket 94 and is affixed to the clamping bracket 92. The inner surfaces of the coupling holes existing through the lugs 110 of the swivel bracket 94 act as bearing surfaces as the swivel bracket 94 rotates about the pivot pin 98. The drive unit 33 thus can be pivoted about the pivot axis defined by the pivot pin 98, through a continuous range of trim positions. In addition, the pivotal connection permits the drive unit 33 to be trimmed up or down in a trim adjustment range, as well as to be tilted up in a tilt range and out of the water for storage or transport. The trim adjustment range includes a fully trimmed down position to a fully trimmed up position, while the tilt range continuously extends above the trim adjustment range and includes a fully tilted down position (i.e., the fully trimmed up position) to a fully tilted up position, as known in the art.

A hydraulically-operated tilt and trim adjustment mechanism 122 is nested in major part between the clamping bracket 92 and the swivel bracket 94, and operates therebetween to effectuate the tilt and trim movement of the drive unit 33. In the illustrated embodiment, an upper portion of the mechanism 122 is interposed between the side arms 108 of the swivel bracket 94. While the present embodiment is described in the context of a hydraulic system, other types of working fluids (e.g., air, nitrogen) can also be used.

Figure 4:
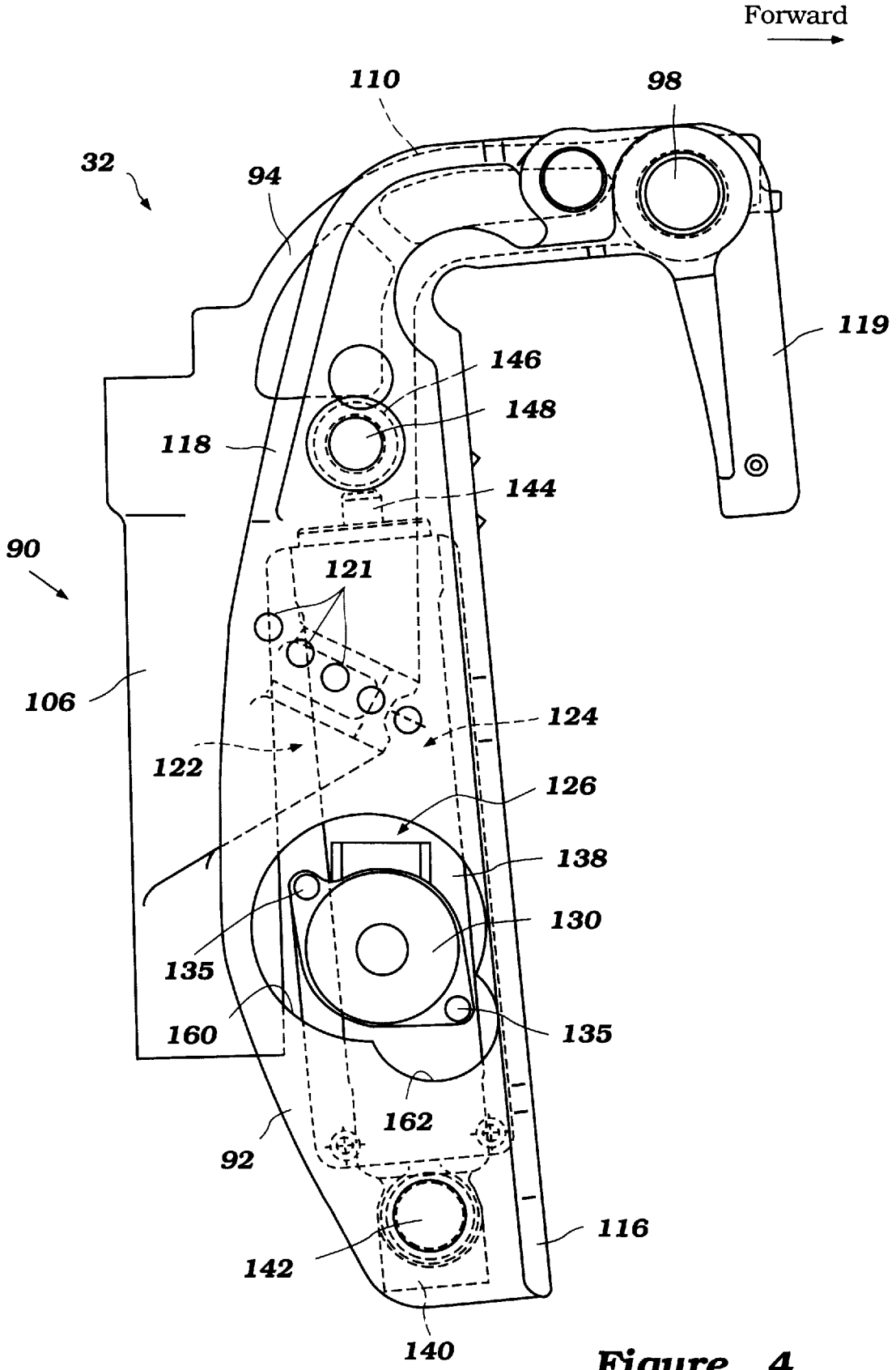
FIG. 4 is an enlarged side elevational view showing a hydraulic tilt and trim adjustment system.
Figure 5:
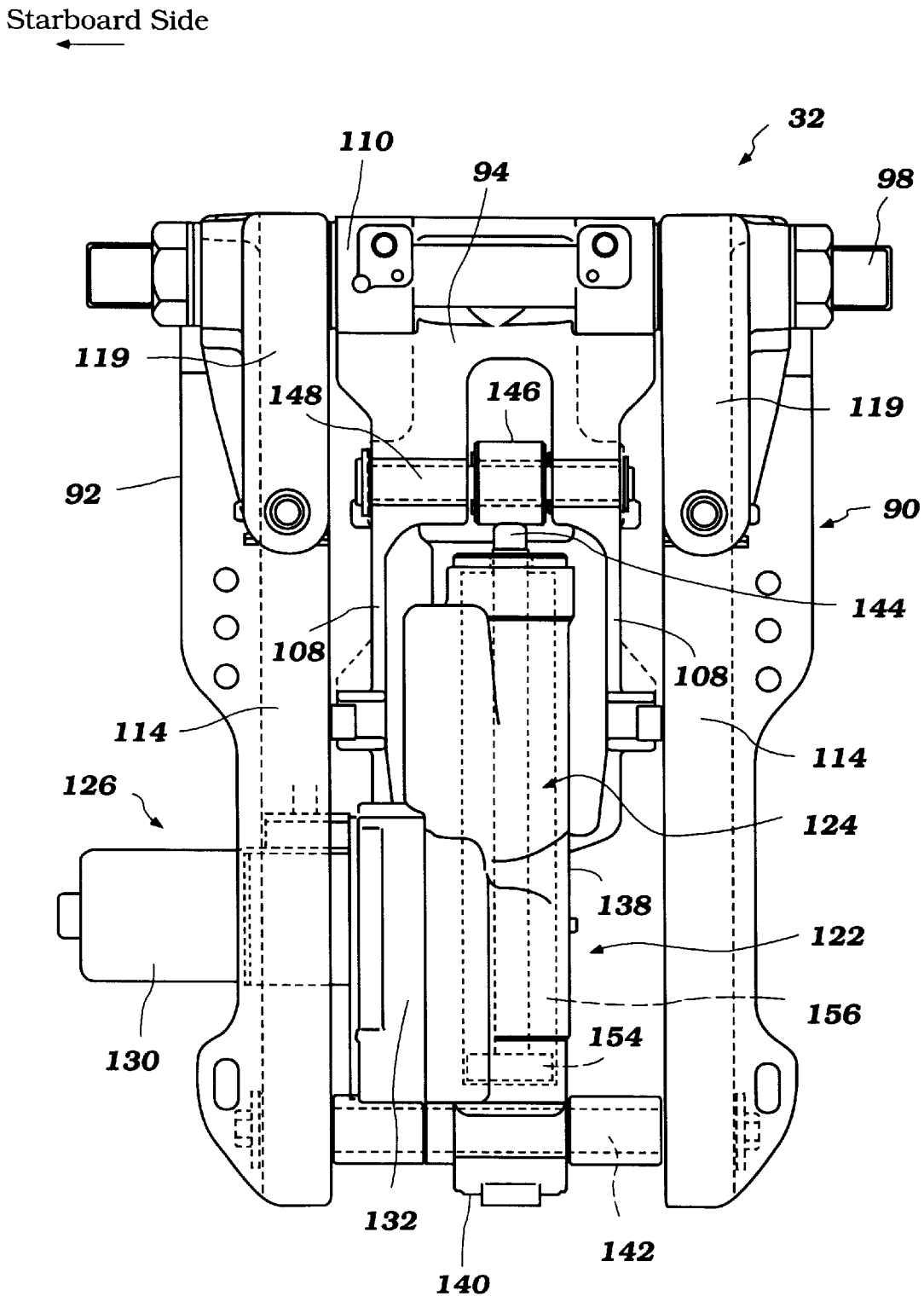
FIG. 5 is an enlarged front view showing the tilt and trim system.

As best seen in FIGS. 4 and 5, the tilt and trim adjustment mechanism 122 in the illustrated embodiment includes a hydraulic actuator assembly 124. The hydraulic actuator assembly 124 is located adjacent to a powering assembly 126 that is another major part of the tilt and trim adjustment mechanism 122. The particular arrangement of them will be described in greater detail below.

The powering assembly 126 includes a reversible electric motor 130 and a reversible hydraulic pump 132. Although any type of pump is applicable, a conventional gear pump is one of the preferred pumps. If the gear pump is applied, a gear combination therein defines a rotary fluid motivation element. In the illustrated embodiment, the pump 132 is unified with the actuator assembly 124 in a common jacket and the motor 130 is affixed to the jacket at its flange portions with screws 135. A rotary shaft of the pump 132 is coupled to an output shaft of the motor 130 so as to be driven by the electric motor 130. The pump 132 communicates with a fluid reservoir that is formed in the common jacket. In addition, a suitable hydraulic circuit which is also defined in the jacket links the pump 132 to the actuator assembly 124. Any conventional hydraulic circuit can be applied inasmuch as it complies with functions that are required to the tilt and trim adjustment mechanism 122. For instance, one of the typical hydraulic circuits is described in U.S. Pat. No. 5,049,099.

The actuator assembly 124 includes a cylinder 138 having a lower trunnion 140 with a bore that receives a pin 142 to provide a pivotal connection to a lower portion of the clamping bracket 92, and specifically to the bracket arms 114.

An actuator arm or rod 144, that projects beyond an upper end of the cylinder 138, also has an upper trunnion 146 with a bore. The bore of the trunnion 146 receives a pivot pin 148 that pivotally connects the actuator rod 144 to the side arms 108 of the swivel bracket 94 and therebetween via the pivot pin 148.

The cylinder 138 has a closed bottom at its lower end. The other end where the rod 144 projects is closed with a cap having a hole through which the rod 144 can reciprocate. That is, the cap slidably holds the rod 144 via a proper sealing member.

A piston 154 is disposed within the cylinder 138 and slides axially therein. In other words, an inner wall of the cylinder 138 slidably supports the piston 154. A lower end of the actuator rod 144 is connected to the piston 154, as seen in FIG. 5. The piston 154 includes one or more O-rings to inhibit leakage of working fluid across the piston 154. In this manner, the piston 154 divides the inner space within the cylinder 138 into an up variable-volume fluid chamber or lower chamber, which is located below the piston 154, and a down variable-volume fluid chamber or upper chamber 156, which is located above the piston 154. Since FIG. 5 illustrates that the piston 154 is placed at the lowermost position, the up variable-volume fluid chamber is not formed below the piston 154. Incidentally, when the piston 154 is positioned here, the rod 144 is nearly confined within the cylinder 138 and the drive unit 33 is placed at the fully trimmed down position. The piston 154 also can include a suitable pressure relief mechanism that allows fluidic communication between the chambers under abnormal operating conditions, as well known in the art.

As best seen in FIG. 5, the hydraulic actuator assembly 124 is arranged such that its stroke axis lies generally within a central plane that bifurcates the coupling assembly 32 and the drive unit 33. Thus, the cylinder 138 lies nested between the bracket arms 114 with the arms 114 symmetrically arranged with respect to the cylinder 138. In the illustrated embodiment, the cylinder 138 also lies symmetrically positioned between the side arms 108 of the swivel bracket 94. In this manner, the stroke axis of the cylinder 138 is positioned generally within the same plane in which the overall center of gravity of the drive unit 33 and the power tilt and trim system 32 is located. FIG. 1 also shows the center of gravity in this side view with the reference letter G.

The powering assembly 126 is located on a relatively lower portion of the cylinder 138. That is, the powering assembly 126 is located near an interaction point between the cylinder 138 and the clamping bracket 92 rather than an interaction point between the actuator rod 144 and the swivel bracket 94 (e.g., near the lower trunnion 140).

The powering assembly 126 extends to the side of the cylinder 138. That is, it projects in the lateral direction and preferably beyond one of the bracket arms 114. In the illustrated embodiment, the powering assembly 126 extends toward the bracket arm 114 that exists on the starboard side. The bracket arm 114 on this side, therefore, has an opening. In the illustrated embodiment, the opening is formed as a through-hole 160 (see FIG. 4); however, the opening can also have other shapes and sizes in order to receive at least a portion of the powering assembly. In one variation, the opening can be a recess within the arm.

The hole 160 is formed on the flange section 118 of this arm 114. At least the motor 130 protrudes through the hole 160 in this arrangement. The axis of the motor output shaft and the pump shaft desirably lie generally normal to the stroke axis of the cylinder 138. A diameter of the through-hole 160 is greater than at least a diameter of an in-portion of the powering assembly 126 that exists within the hole 160.

A center of the through-hole 160 is off set rearwardly from a center of the in-portion of the powering assembly 126, i.e., the motor 130 in the illustrated embodiment. This is because the center of the powering assembly 126 moves slightly rearwardly when the actuator assembly 124 operates. More specifically, with reference to FIG. 4, the pivot pin 148 moves upwardly and rearwardly around the pivot pin 98 when the swivel bracket 94 rotates clockwise, i.e., the drive unit 33 is going to be tilted up. With this movement, the cylinder 138 pivots around the pivot pin 142 anti-clockwise and hence the center of the powering assembly 126 moves rearwardly.

In the illustrated embodiment, the through-hole 160 is not formed as a right circle but rather has an additional sub circle portion 162. This configuration is advantageous because the powering assembly 126 can be repaired without deassembling the clamping bracket 92. In addition, the entire hole does not need to be so large in comparison with a right circle that has a diameter covering the sub hole. Thus, the major part of the powering assembly 126 as well as the actuator assembly 122 nested between the bracket arms 118 can be sufficiently protected.

The protrusion of the powering assembly 126 will be a good sign for indicating the user to recognize that this side should not be put down toward the ground. This is useful not only for preventing the powering assembly 126 itself from being damaged but also for the air induction device 46 from having fuel and/or lubricant therein which may accumulate in the induction device 46 if the device 46 is placed downwardly. As described above, in the illustrated embodiment, the air induction device 46 extends on the same side. In other words, the bracket arm 114 that has the opening 160 is positioned closer to the side 51, on which the air induction device 44 extends, than the other side 52. Thus, when the outboard motor 30 is so placed to direct the powering assembly 126 upwardly, the air induction device 46 can never be placed downwardly, and the fuel and/or lubricant will not accumulate therein. Accordingly, any fuel and/or lubricant can flow into the combustion chambers from the air induction device 46.

The pump 132 includes a pair of outlet ports that communicate with inlet ports formed in the cylinder 138. As aforedescribed, the outer housings of the assemblies 124, 126 are common in the illustrated embodiment. However, it should be noted that the assemblies 124, 126 may comprise separate pieces that are affixed to each other. By having intermitting ports, the necessity for providing external conduits is avoided and the construction is more compact.

To trim or tilt up the drive unit 33, the pump 132 is driven by the motor 130 in a certain direction that causes the working fluid to be supplied to the lower chamber of the cylinder 138. The fluid pressurizes the piston 154 to move upwardly and hence the actuator rod 144 goes out of the cylinder 138. This movement of the actuator rod 144 lifts up the drive unit 33 to a desired trimmed or tilted up position. With this action of the actuator assembly 124, the powering assembly 126 slightly moves rearwardly. However, the center of the powering assembly 126 is initially set forwardly in regard to the center of the through-hole 160, as noted above. The flange section 118 of the bracket arm 114, therefore, will not prevent the powering assembly 126 from moving rearwardly.

Figures 6A, 6B:
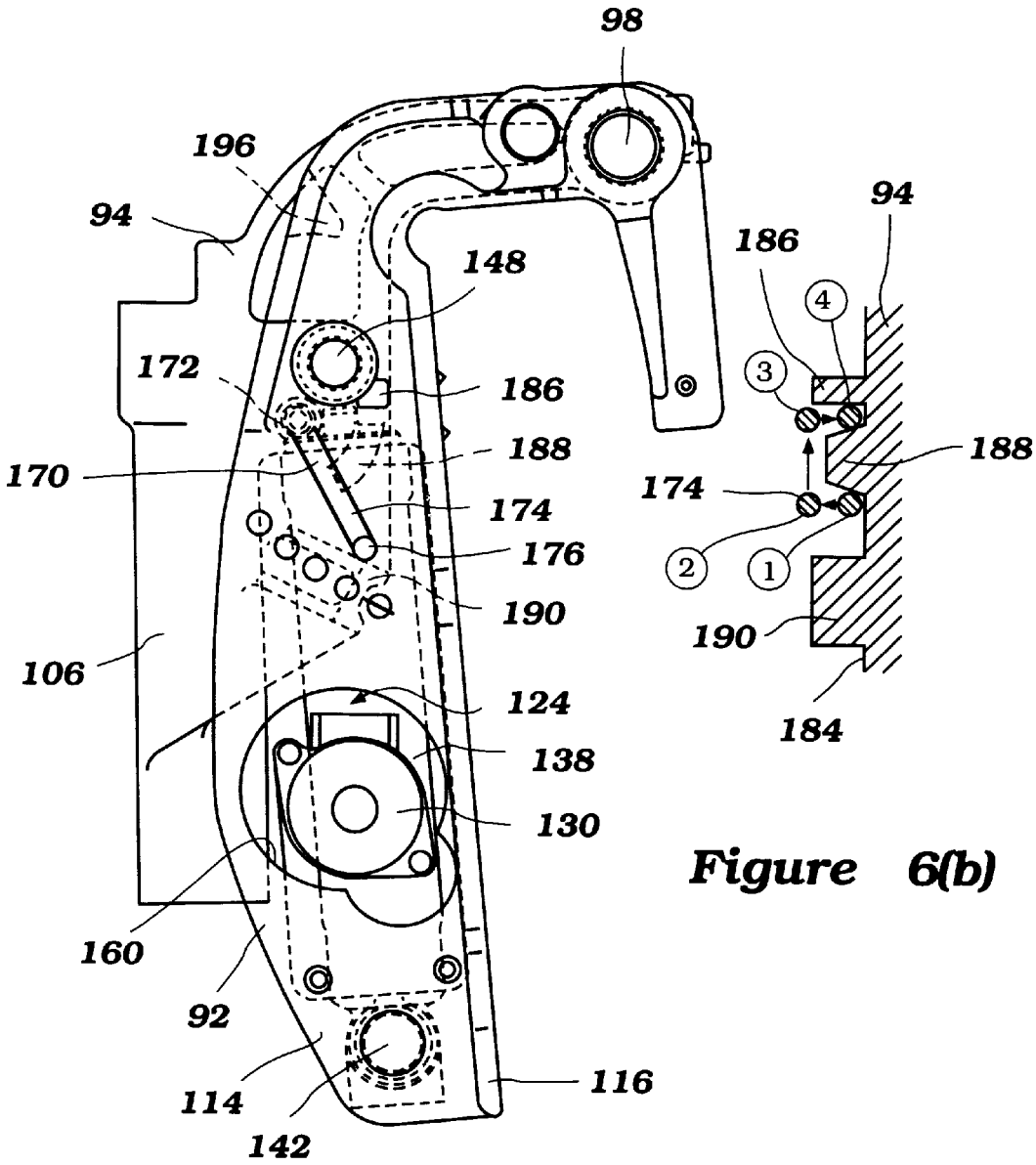
FIG. 6(*a*) is a side elevational view of the tilt and trim system to show particularly a tilt stop mechanism.

If the user of the outboard motor 30 wants to place the drive unit 33 at the fully tilted up position, he or she may use a tilt stopper that is omitted in FIGS. 1 to 5. With reference to FIGS. 6(*a*) to 8, the tilt stopper and its function will be described.

Figure 7:
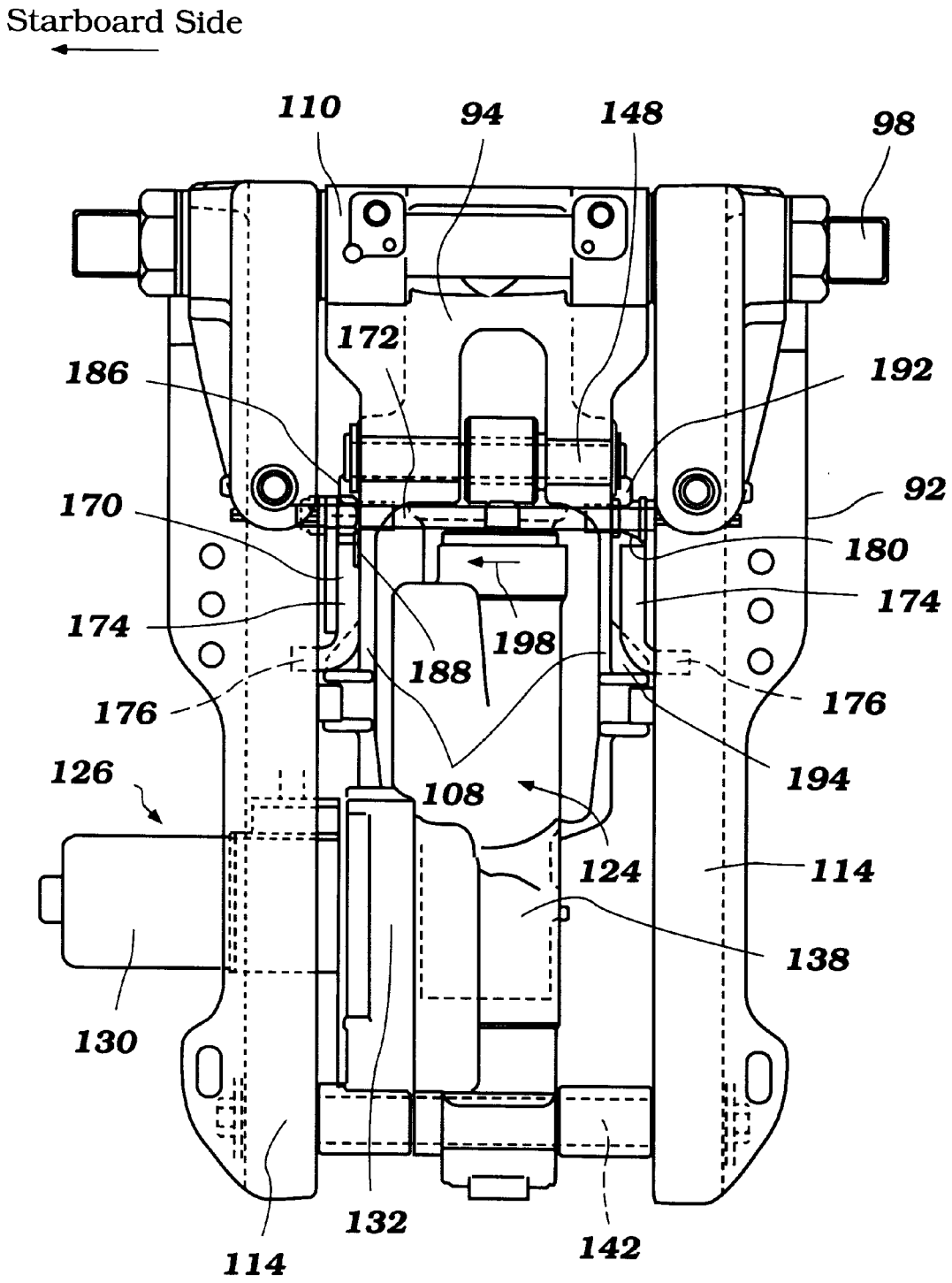
FIG. 7 is an enlarged front view showing the tilt and trim system with the tilt stop mechanism.

The tilt stopper is designated by the reference numeral 170 and comprises a pivot pin section 172, a pair of lever sections 174 extending from the pin section 172, engage sections 176 extending from the respective lever sections 174 and a grip 178 (omitted in FIGS. 6 and 7) disposed at one end of the pin section 172. The pivot pin section 172 is supported by the side arms 108 of the swivel bracket 94 for pivotal movement. The pin section 172 is also slidable along its slide axis. A spring 180 biases the tilt stopper 170 toward the port side (right-hand side in FIG. 7) so that the lever section 174 on the starboard side (left-hand side in FIG. 7) abuts the side arm 108 on the same side. The position where the pin section 172 is disposed is the proximity to the pivot pin 148 that supports the upper trunnion 146 of the actuator rod 144.

As best seen in FIG. 6(*b*), an outer wall 184 of the swivel bracket 94 on the starboard side has an upper projection 186, a middle projection 188 and a lower projection 190. Meanwhile, another outer wall on the port side has an upper projection 192 and a lower projection 194. Both of the upper projections 186, 192 have generally the same configurations. Also, both of the lower projections 190, 194 have generally the same configurations. When the swivel bracket 94 is placed at the fully trimmed down position, the lever section 174 on the starboard side abuts a lower surface of the middle projection 188 and the respective engage sections 176 are positioned on each upper surface of the lower projections 190, 194.

Both inner walls of the flange sections 118 of the bracket arms 114 are provided with recesses 196 that can receive the respective engage sections 176 when the swivel bracket 94, i.e., the drive unit 33, stays at the fully tilted up position. The flange sections 118 of the bracket arms 114 also have depressions so that these sections 118 do not prevent the engage sections 176 of the tilt stopper 170 from moving within the trim and tilt range. The depressions are, therefore, forms along loci of the engage sections 176.

Figure 8:
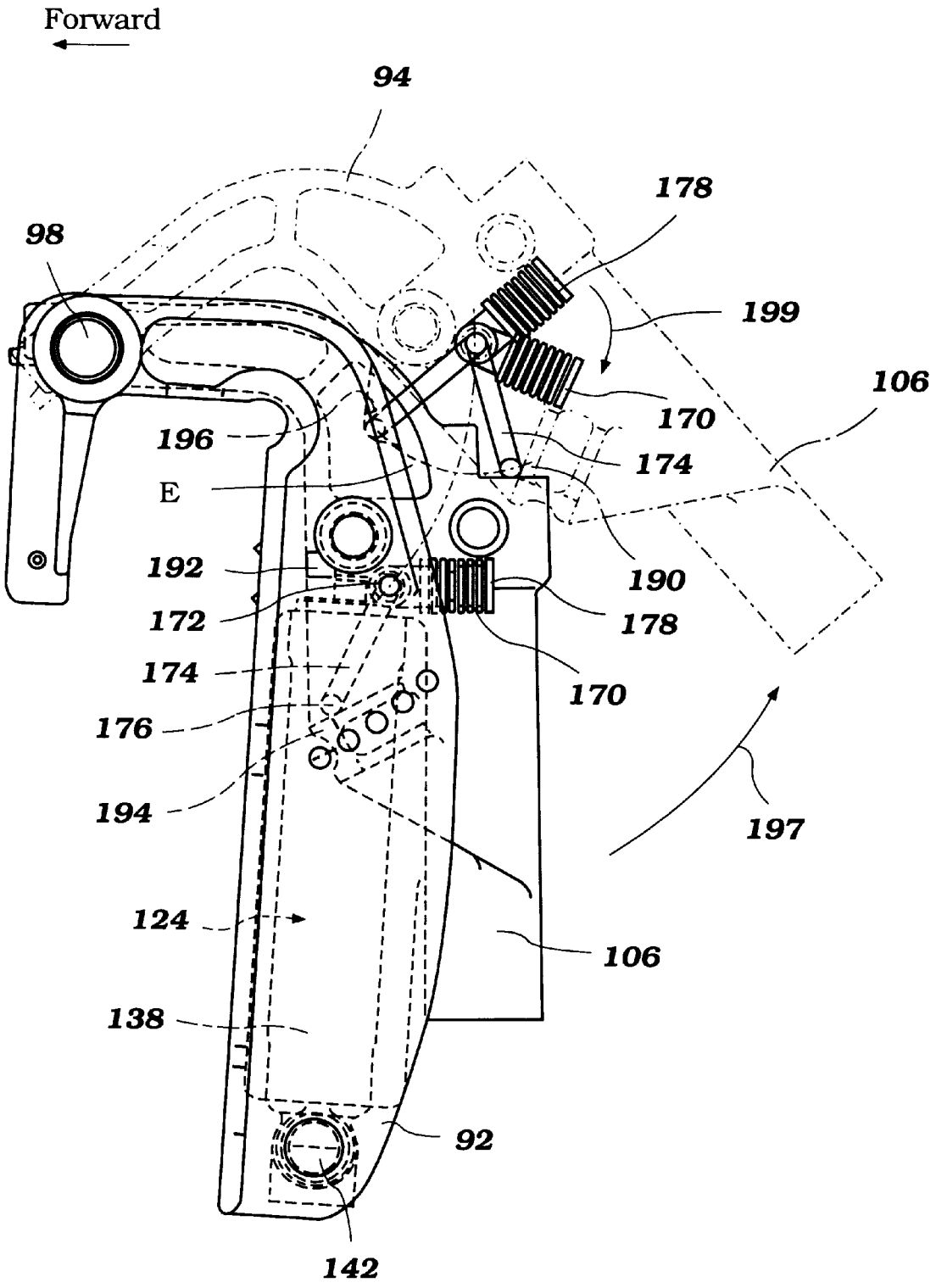
FIG. 8 is an enlarged side elevational view of the tilt and trim system including a tilt stop led as well as the tilt pin and showing how the tilt pin moves while the swivel bracket is shifted in a trim and tilt range.

In FIG. 8, the swivel bracket 11 is rotated anti-clockwise as indicated by the arrow 197 by the actuator assembly 124. When the user wants to hold the drive unit 33 at the fully tilted up position, he or she shifts the pivot pin section 172 toward the starboard side (the left-hand side in FIG. 7) against the biasing force of the spring 180 by operating the grip 178 as indicated by the arrow 198 in FIG. 7. This shift allows the lever section 174 on the starboard side to climb over the middle projection 188. After climbing over the middle projection 188, the user releases the pivot pin section 172 so that the section 172 may shift toward the port side by the biasing force of the spring 180 and then the lever section 174 fits into the recess formed between the middle projection 188 and the upper projection 186 as seen in FIG. 6(*b*). The arrows shown in FIG. 6(*b*) indicate the movement of the lever section 174. When the lever sections 174 abut the upper projections 186, 192, the user rotates the grip 178 clockwise as indicated with the arrow 199 in FIG. 8 so as to engage the engage sections 176 with the recesses 196 on the bracket arms 114 of the clamping bracket 92. A locus of the engage sections 176 is indicated with a phantom line E in FIG. 8. When engaging the engage sections 176 to the recesses 196, the swivel bracket 94 is slightly lowered down. By completing the engagement of the sections 176 with the recesses 196, the tilt stopper 170 can hold the swivel bracket 94 as well as the drive unit 33 at the fully tilted up position.

To trim or tilt down the drive unit 33, the tilt stopper 170 is returned to its initial position with the inverse movement. The pump 132 is, then, driven by the motor 130 in an opposite direction that causes the working fluid to be supplied to the upper chamber 156 of the cylinder 138. The fluid pressurizes the piston 154 to move downwardly and hence the actuator rod 144 is drawn back into the cylinder 138. This movement of the actuator rod 144 lowers the drive unit 33 lowered down to a desired trim or tilt down position.

It should be noted that the actuator assembly 124 can be positioned upside down in regard to the coupling assembly 90. In this alternative connection, it is acceptable even if the trunnion 140 of the cylinder 138 is coupled with the pivot pin 148 and the trunnion 146 of the actuator rod 144 is coupled with the pivot pin 142.

As described above, in the illustrated embodiment, one of the bracket arms has an opening and at least a portion of the powering assembly extends through the opening. Since the portion of the powering assembly does not require to be positioned between the bracket arms, the hydraulic tilt and trim system can be constructed in compact nature. In addition, the respective bracket arms can have sufficient lengths for supporting the drive unit even under the condition that the powering assembly extends beyond the bracket arm. The clamping bracket, thus, can keep sufficient strength.

Figure 9:
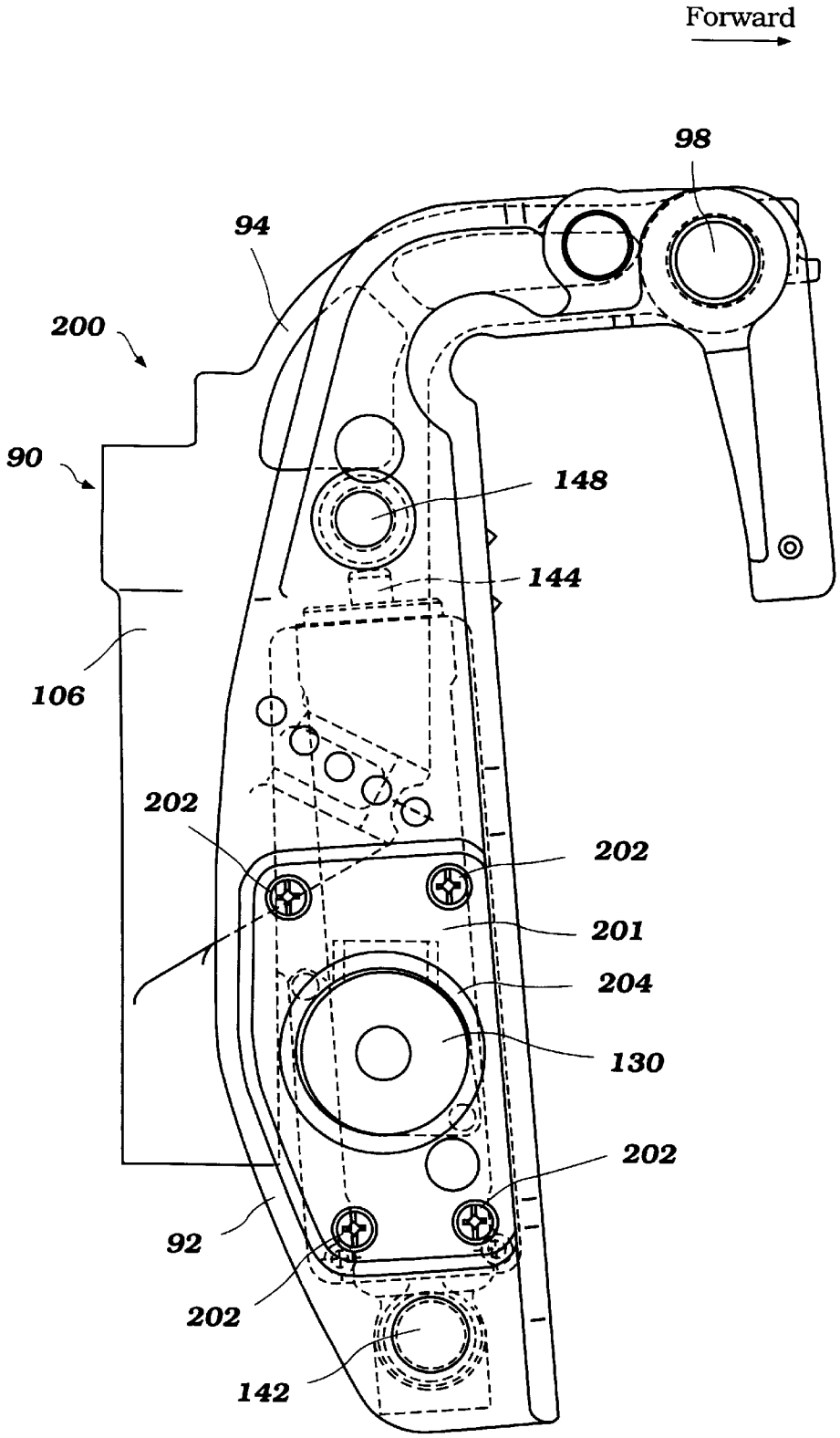
FIG. 9 is an enlarged side elevational view showing another hydraulic tilt and trim adjustment at is configured in accordance with another preferred embodiment of the presention.
Figure 10:
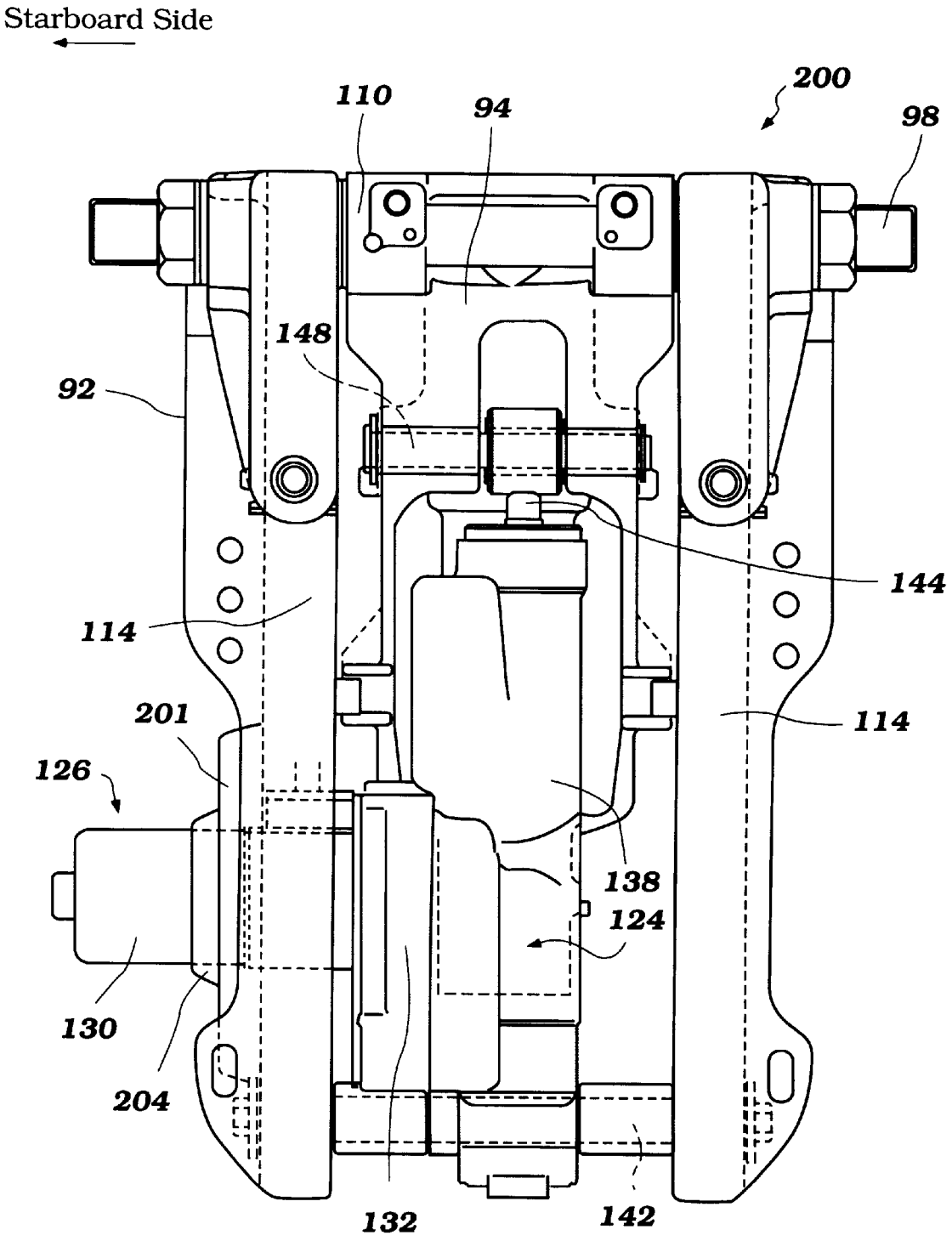
FIG. 10 is an enlarged front view of the tilt and trim system shown in FIG. 9.

FIGS. 9 and 10 illustrate a hydraulic tilt and trim adjustment system 200 configured in accordance with a second embodiment of the present invention. The same member and components that have been described in connection with the first embodiment shown in FIGS. 1 to 8 will be assigned with the same reference numerals and not repeatedly described.

In this embodiment, a cover member 201 is affixed to the flange section 118 of the bracket arm 114 that has the through-hole 160 with screws 202. The cover member 201 has a flange portion 204 that can close a gap that is formed between the powering assembly 126 and the flange section 118. Because the powering assembly 126 moves back and forth slightly in the hole 160 with the tilt movement, at least the flange portion 204 is preferably made of an elastic material such as, for example, a rubber or synthetic resin. In the illustrated embodiment, the entire cover member 201 is made of the elastic material. It is desirable that the flange portion 204 generally entirely abuts the outer body of the powering assembly 126.

The cover member 201 is advantageous not only for improving an appearance of the outboard motor 30 but also inhibiting a foreign article from being caught in the gap and hindering the powering assembly 126 in moving.

Figure 11:
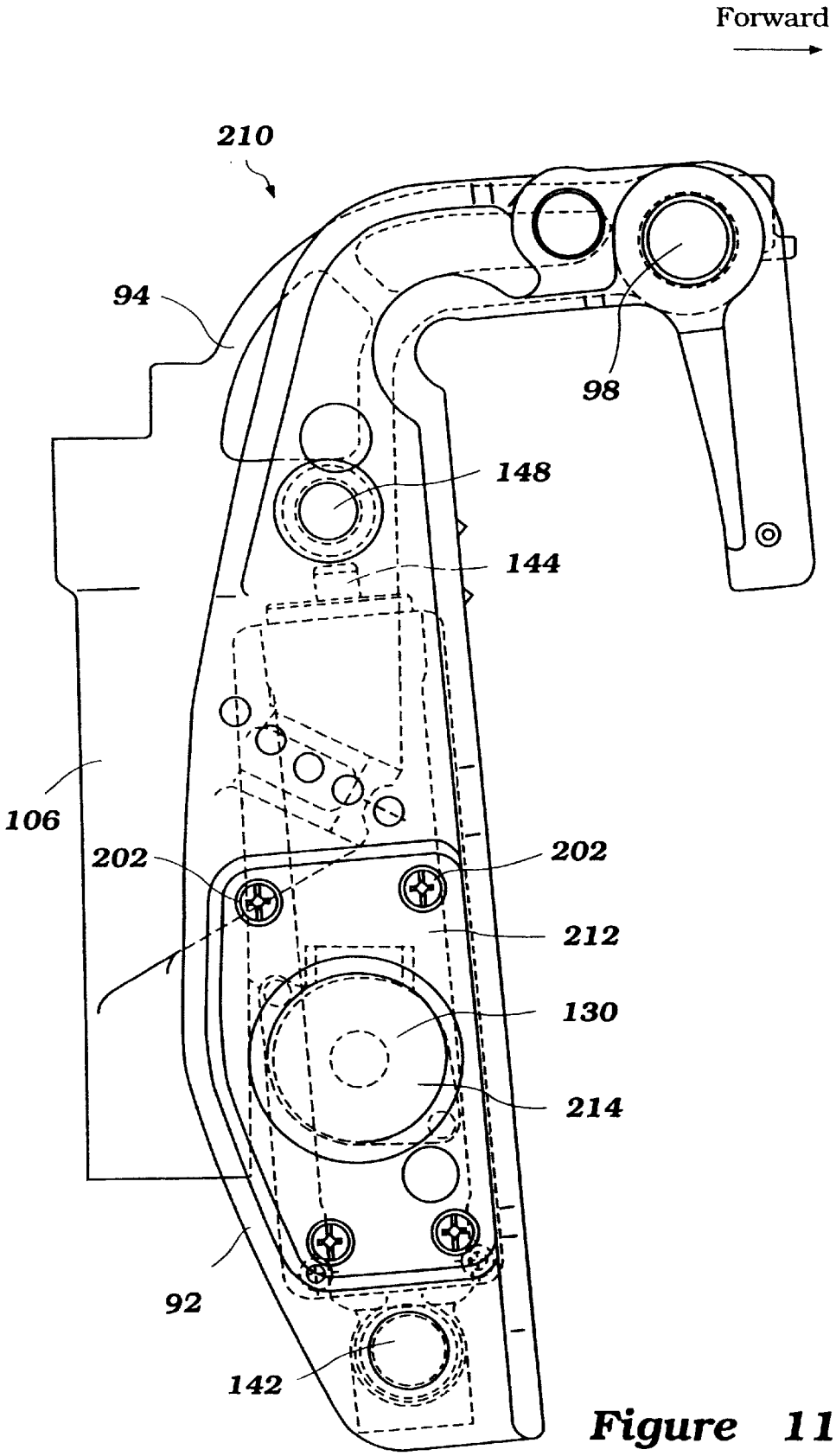
FIG. 11 is an enlarged side elevational view showing a further hydraulic tilt and trim adjustment system that is configured in accordance with an additional preferred embodiment of the present invention.
Figure 12:
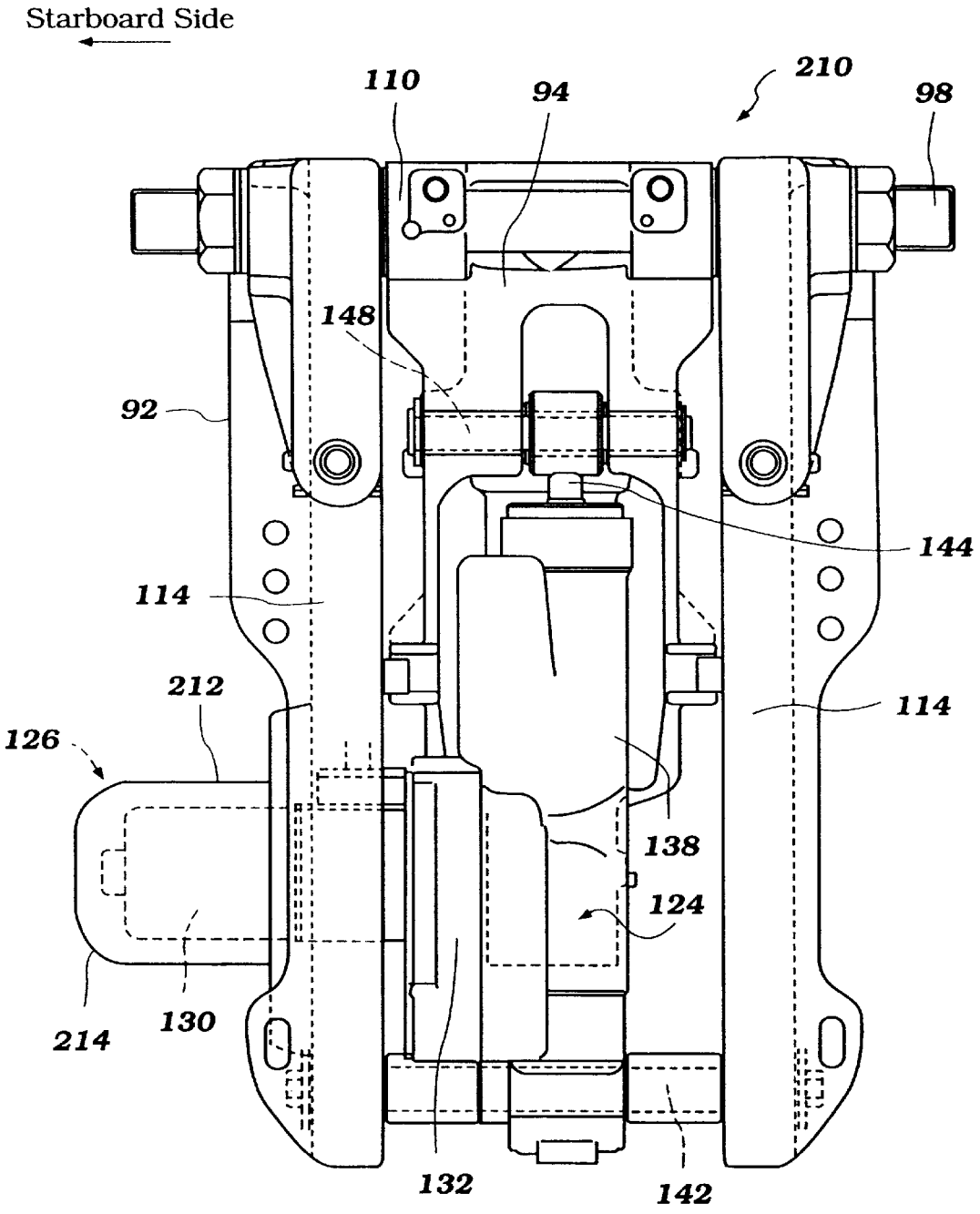
FIG. 12 is an enlarged front view of the tilt and trim system shown in FIG. 11.

FIGS. 11 and 12 illustrate a further hydraulic tilt and trim adjustment system 210 configured in accordance with a second embodiment of the present invention. Like the second embodiment, the same member and components will be assigned with the same reference numerals.

In this embodiment, another cover member 212 is provided that has a configuration different from the cover member 201 in the second member. That is, the cover member 212 has a cover portion 214, instead of the flange portion 204, that completely cover the powering assembly 214 as well as the gap between the assembly 214 and the flange section 118 of the bracket arm 114. In order to permit the powering assembly 126 to move freely, the cover portion 214 defines an inner hollow that has a relatively large capacity. The cover member 212 is affixed to the flange section 118 with screws 202 just like the cover member 201.

The cover member 212 can provide with a great advantage such that it completely inhibits a foreign article from being caught in the gap in addition to the advantage of good appearance.

The bracket arm 114 that exists in the vicinity of the powering assembly 126 can have a unified cover section or hollow section which is similar to the cover portion 214 of the cover member 212 in the third embodiment. In this alternative, the cover section can be formed by, for example, a drawing method with a press machine.

The through-hole or opening on the bracket arm can be formed with an upper flange section and a lower flange section that are separately prepared and joined with each other by appropriate coupling members.

Also, the through-hole can be configured with any shape inasmuch as the powering assembly passes therethrough such as, for example, a rectangular slit.

The portion of the powering assembly that passes through the opening is not limited to the electric motor. Even a major part of the pump can be included in the portion.

The illustrated arrangements can be applied to large size outboard motors as well as small size outboard motors.

Of course, the foregoing description is that of preferred embodiments of the invention, and various changes and modifications may be made without departing from the spirit and scope of the invention, as defined by the appended claims.

What is claimed is:

1. A hydraulic tilt and trim system for an outboard drive comprising a support member that is adapted to couple to the outboard drive, the support member including a pair of bracket arms spaced apart from each other, one of the bracket arms having an opening, an actuator nested between the bracket arms and arranged to move the outboard drive, and a powering assembly disposed next to the actuator and arranged to power the actuator, at least a portion of the powering assembly lies within the opening.

2. A hydraulic tilt and trim system as set forth in claim 1, wherein the portion of the powering assembly extends through the opening.

3. A hydraulic tilt and trim system as set forth in claim 1, wherein the actuator includes a rod extendable along a stroke axis, the powering assembly includes a pump selectively supplying a working fluid to the actuator so as to move the rod, the pump has a rotary shaft that rotates about a rotational axis, and the pump is oriented such that the rotational axis lies generally normal to the stroke axis.

4. A hydraulic tilt and trim system as set forth in claim 3, wherein the powering assembly additionally includes a motor selectively driving the pump, the motor has an output shaft that rotates about a drive axis and is connected to the rotary shaft, and the motor is oriented such that the drive axis lies generally normal to the stroke axis.

5. A hydraulic tilt and trim system as set forth in claim 1, wherein a size of the opening is greater than at least a size of the portion of the powering assembly that lies within the opening.

6. A hydraulic tilt and trim system as set forth in claim 5, wherein a center of the portion of the powering assembly, which lies within the opening, is off set from a center of the opening.

7. A hydraulic tilt and trim system as set forth in claim 1, wherein the powering assembly is movable within the opening when the actuator tilts the outboard drive, and the opening has a diameter that allows the powering assembly to move without contacting a side of the opening.

8. A hydraulic tilt and trim system as set forth in claim 1, wherein the support member has a closure member that generally closes a gap formed between the powering assembly and the bracket arm.

9. A hydraulic tilt and trim system as set forth in claim 8, wherein the closure member is made of an elastic material.

10. A hydraulic tilt and trim system as set forth in claim 1, wherein the support member has a cover member that covers a portion of the powering assembly that projects beyond the bracket arm having the opening.

11. A hydraulic system as set forth in claim 10, wherein the cover member is made of an elastic material.

12. A hydraulic tilt and trim system as set forth in claim 10, wherein the cover member defines a hollow in which the portion of the powering assembly is enclosed, the powering assembly is movable within the hollow when the actuator tilts the outboard drive, and the hollow has a capacity that allows the portion of the powering assembly to move without contacting the cover member.

13. A hydraulic tilt and trim system as set forth in claim 1, wherein the powering assembly is located near the point where the actuator is connected the clamping bracket.

14. A hydraulic tilt and trim system as set forth in claim 1, wherein the outboard drive includes an internal combustion engine therein to power a marine propulsion device, the engine has a cylinder body that defines a cylinder bore in which a piston reciprocates, a cylinder head that closes an end of the cylinder body and defines a combustion chamber with the piston and the cylinder head, and an air induction device arranged to supply an air charge to the combustion chamber, the cylinder body has a pair of sides that extend generally along a reciprocation axis of the piston, the air induction device extends along only one of the sides, and the bracket arm that has the opening is adapted to be positioned closer to the side on which the air induction device extends than the other side of the engine.

15. A hydraulic tilt and trim system for an outboard drive comprising a clamping bracket including a pair of arm members spaced apart from each other, one of the arm members having a through-hole, a swivel bracket supporting the outboard drive, an actuator arranged to operate generally between the clamping bracket and the swivel bracket, the actuator including a variable volume fluid chamber and an extendable rod, a pump selectively supplying a working fluid to the fluid chamber so as to move the rod, and a motor selectively driving the pump, and at least a portion of the motor extending through the through hole.

16. A hydraulic tilt and trim system as set forth in claim 15, wherein the motor rotates an element of the pump about a rotational axis that is generally normal to an axis of the rod of the actuator.

17. A hydraulic tilt and trim system as set forth in claim 15, wherein a diameter of the through hole is greater than a diameter of a portion of the powering assembly that lies within the through hole.

18. A hydraulic tilt and trim system as set forth in claim 17, wherein a center of the portion of the powering assembly, which lies within the through hole, is off set from a center of the through hole.

19. A hydraulic tilt and trim system for an outboard drive having a propulsion unit, comprising a clamping bracket adapted to be affixed to an associated watercraft, a swivel bracket held by the clamping bracket for pivotal movement about a generally horizontally extending pivot axis and adapted to support the propulsion unit for pivotal movement about a generally vertically extending steering axis, the clamping bracket including a pair of arm members spaced apart from each other, one of the arm members having a through-hole, a cylinder, a piston slidably supported within the cylinder and defining a variable volume fluid chamber, an actuator rod extending from the piston beyond the cylinder, one of the cylinder and the actuator rod being affixed to a shaft that connects the respective arm members for pivotal movement, the other one of the actuator rod and the cylinder being affixed to the swivel bracket for pivotal movement, a powering assembly disposed near to the cylinder so as to selectively supply working fluid to the fluid chamber, and a portion of the powering assembly extending through the through hole of the arm member.

20. A hydraulic tilt and trim system as set forth in claim 19, wherein the powering assembly includes a pump and a motor that drives the pump, and the portion of the powering assembly that extends through the through-hole includes at least part of the motor.

21. A hydraulic tilt and trim system as set forth in claim 19, wherein the powering assembly has an element that rotates about a rotational axis, and the rotational axis is generally normal to an axis of the actuator rod.

22. A hydraulic tilt and trim system for an outboard drive comprising a support member that is adapted to couple to the outboard drive, the support member including a pair of bracket arms spaced apart from each other, one of the bracket arms having an opening that opens into a hollow formed on an outer side of the bracket arm, an actuator nested between the bracket arms and arranged to move the outboard drive, and a powering assembly disposed next to the actuator and arranged to power the actuator, at least a portion of the powering assembly lies within the hollow.

23. An outboard motor comprising an internal combustion engine for powering a marine propulsion device, the engine having a cylinder body that defines a cylinder bore in which a piston reciprocates, a cylinder head closing an end of the cylinder body and defining a combustion chamber with the piston and the cylinder head, an air induction device arranged to supply an air charge to the combustion chamber, the cylinder body having a pair of sides that extend generally along a reciprocation axis of the piston, the air induction device disposed on only one of the sides, a drive unit carrying the marine propulsion device, a hydraulic tilt and trim system supporting the drive unit, the hydraulic tilt and trim system including a support member that couples to the drive unit and has a pair of bracket arms spaced apart from each other, one of the bracket arms having an opening, an actuator nested between the bracket arms and arranged to move the drive unit, and a powering assembly disposed next to the actuator and arranged to power the actuator, at least a portion of the powering assembly extending through the opening, and the bracket arm that has the opening being positioned closer to the side on which the air induction device is disposed than the other side of the engine.

* * * * *